US009132481B2

(12) United States Patent
Friedrichs

(10) Patent No.: US 9,132,481 B2
(45) Date of Patent: Sep. 15, 2015

(54) METHOD OF PROCESSING METAL POWDER

(76) Inventor: Arno Friedrichs, Kulmbach (DE)

( * ) Notice: Subject to any disclaimer, the term of this patent is extended or adjusted under 35 U.S.C. 154(b) by 952 days.

(21) Appl. No.: 13/265,652

(22) PCT Filed: May 28, 2010

(86) PCT No.: PCT/EP2010/057383

§ 371 (c)(1),
(2), (4) Date: Oct. 21, 2011

(87) PCT Pub. No.: WO2010/139614

PCT Pub. Date: Dec. 9, 2010

(65) Prior Publication Data

US 2012/0060576 A1 Mar. 15, 2012

(30) Foreign Application Priority Data

Jun. 6, 2009 (DE) ..... 10 2009 024 120

(51) Int. Cl.
*B21D 37/16* (2006.01)
*B22F 9/04* (2006.01)
*B22F 9/10* (2006.01)

(52) U.S. Cl.
CPC .... *B22F 9/04* (2013.01); *B22F 9/10* (2013.01)

(58) Field of Classification Search
CPC ..... B22F 9/10; B22F 9/04
USPC ..... 148/513
See application file for complete search history.

(56) References Cited

U.S. PATENT DOCUMENTS 2,181,123 A * 11/1939 Drapeau, Jr. et al. ..... 148/513
5,039,476 A * 8/1991 Adachi et al. ..... 419/13
2008/0118391 A1* 5/2008 Crawley et al. ..... 420/427
2009/0090435 A1* 4/2009 Hoshina et al. ..... 148/513
2012/0111147 A1 5/2012 Friedrichs

FOREIGN PATENT DOCUMENTS

| | | | |
|---|---|---|---|
| EP | 1 839 783 | | 10/2007 |
| JP | S61-166905 | A | 7/1986 |
| JP | H01-321096 | A | 12/1989 |
| JP | H02-298333 | A | 12/1990 |
| JP | H03-130301 | A | 6/1991 |
| JP | 2004 043883 | | 2/2004 |
| JP | 2006 351688 | | 12/2006 |
| JP | 2012-529561 | A | 11/2012 |
| WO | WO 00/56486 | | 9/2000 |

OTHER PUBLICATIONS

Merriam-Webster's Collegiate Dictionary, Tenth Edition, 1997, p. 348.*

International Search Report of PCT/EP2010/057383, date of mailing Sep. 22, 2010.

* cited by examiner

*Primary Examiner* — Jessee Roe
*Assistant Examiner* — Christopher Kessler
(74) *Attorney, Agent, or Firm* — Collard & Roe, P.C.

(57) ABSTRACT

The invention relates to a method of processing metal powder consisting a plurality of metal powder pellets, comprising the following steps:

heating the metal powder pellets until they are in a doughy state, causing a collision of the metal power pellets in doughy state with an impact body to form deformed metal powder particles and collecting the deformed metal powder particles in a collecting vessel.

10 Claims, 1 Drawing Sheet

METHOD OF PROCESSING METAL POWDER

CROSS REFERENCE TO RELATED APPLICATIONS

This application is the National Stage of PCT/EP2010/057383 filed on May 28, 2010, which claims priority under 35 U.S.C. §119 of German Application No. 10 2009 024 120.5 filed on Jun. 6, 2009, the disclosure of which is incorporated by reference. The international application under PCT article 21(2) was not published in English.

The invention relates to a method of processing metal powder consisting of a plurality of metal powder pellets.

BACKGROUND OF THE INVENTION

A method of producing steel powder consisting of plurality of steel powder pellets is already known. In this known method a steel melt is produced. This is transferred to a container and acted on there by $N_2$ gas so as to effect an atomisation of molten steel with use of nitrogen gas. By means of this known method, which is performed in a protective gas atmosphere, steel powder is produced which consists of a plurality of steel powder pellets having a diameter in the range between 100 microns and 500 microns.

It has proved that it is advantageous or even necessary for certain industrial applications to make available metal powder with non-spherical metal powder particles.

The object of the invention consists in indicating a method of processing metal powder consisting of a plurality of metal powder pellets, by means of which it is possible to produce metal powder with non-spherical metal powder particles.

BRIEF DESCRIPTION OF THE DRAWINGS

This object is fulfilled by a method with the features indicated in claim 1. Advantageous embodiments and developments of the invention are evident from the following explanation thereof with reference to the figures, in which:

DETAILED DESCRIPTION

Provided as starting material for the method according to the invention is metal powder consisting of a plurality of metal powder pellets having a diameter in the range of 100 μm to 500 μm. Metal powder of that kind can be produced, for example, by means of the above-mentioned method.

Figure 1:
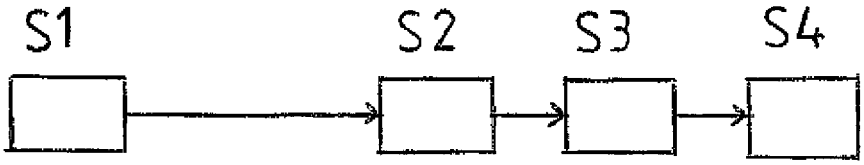
FIG. 1 shows a flow chart for explanation of a method of processing metal powder according to a first exemplifying embodiment for the invention and FIG. 2 shows a flow chart for explanation of a method of processing metal powder according to a second exemplifying embodiment for the invention.

In accordance with the method according to the invention there is carried out—as is evident from FIG. 1—in a first step S1 a heating of the metal powder pellets to a temperature at which the metal powder pellets are in a doughy state. This heating of the metal powder pellets can be undertaken with use of an induction process, through a use of radiant heat or in a hot protective gas flow.

In a second step S2 following thereupon a collision of the metal powder pellets in doughy state with a heated impact body is produced in order to obtain deformed metal powder particles. This impact body can be an impact plate extending at a right angle or another angle to the metal powder pellet flow. This impact plate can be of propeller-shaped construction. Moreover, it can be constructed to be movable, for example rotating or constantly pivoted.

The metal powder particles deformed by collision with the impact plate are, in accordance with a succeeding step S3, collected in a collecting vessel. An advantageous embodiment consists of transporting the deformed metal powder particles into the collecting vessel by means of a conveyor belt, wherein the conveyor belt is arranged between the impact plate and the collecting vessel or wherein the conveyor belt itself serves as impact plate.

An alternative embodiment consists in that the metal powder pellets in doughy state collide with one another in order to obtain deformed metal powder particles with a non-spherical surface.

After the collection of the deformed metal powder particles in the collecting vessel cooling of the deformed metal powder particles is carried in a step S4 until they are again in a solid state. Alternatively, thereto the metal powder particles provided by the step S2 can also be subjected to another processing in the collecting vessel in which they have been collected in accordance with the step S3.

The obtained metal powder particles have, by contrast to the starting material, projections, edges and corners. This is of advantage, for example, when metal powder, which consists of a plurality of metal powder particles deformed in that way is used for production of a drilling tool of, for example, steel with internally disposed helically extending cooling channels, wherein the steel powder is kneaded together with a binder, the steel powder kneaded together with the binder is led through a press-moulding tool in order to produce a strand with internally disposed rectilinear cooling channels, the strand leaving the press-moulding tool is respectively cut to a desired length, the blank arising in that case is with support over its entire length, subjected to a rolling movement at a speed which linearly and constantly changes over the length of the body so that the blank is twisted, and the twisted blank is sintered and then provided at its outer circumference with helically extending cutting grooves.

Tests have shown that production of drilling tools of that kind of steel with internally disposed helically extending cooling channels is not possible with use of steel powder, such as is used as starting material for the method according to the invention, and with use of the method described in the preceding paragraph, since the blank produced is unstable in shape. If, thereagainst, the steel powder which is produced by means of the method according to the invention and which comprises deformed steel powder particles is used for producing drilling tools of steel with internally disposed helically extending cooling channels by means of the method described in the preceding paragraph, then the desired end products can be produced, since the formed twisted blank is stable in shape and can be further processed in desired manner by means of the sintering process. This is attributable to the fact that in the twisted blank the deformed steel powder particles can hook into or at one another so that the desired shape of the blank is maintained.

Figure 2:
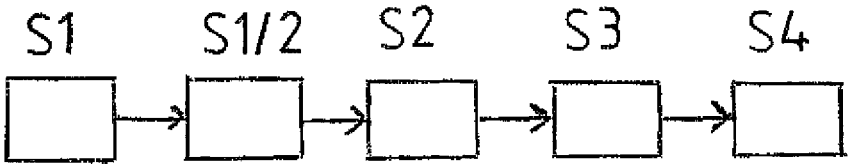

An improved method for processing metal powder is explained in the following with reference to the flow chart shown in FIG. 2.

In this improved method as well, in which the same metal powder is used as starting material as in the case of the method explained with reference to FIG. 1, heating of the metal powder pellets is carried out in a first step S1 to a temperature at which the metal powder pellets are in a doughy state.

In a succeeding step S1/2 the metal powder pellets in doughy state are subjected to an acceleration. This acceleration can be undertaken by a magnetic field, by means of a centrifuging process or by means of a protective gas flow.

The accelerated metal powder pellets in doughy state are subjected in a succeeding step S2 to a collision with an impact body in order, just as in the case of the method explained with reference to FIG. 1, to be deformed.

The metal powder particles deformed by the collision are collected in a collecting vessel in accordance with a succeeding step S3, where they cool in accordance with a step S4 so that the metal powder particles are finally in a solid state.

Through the described acceleration of the metal powder pellets in doughy state the kinetic energy thereof is increased so that the metal powder pellets on impact thereof with the impact body are more strongly deformed than in the case of the exemplifying embodiment described with reference to FIG. 1.

This has the advantage that the above-described hooking of the metal powder particles in the blank is improved, which in turn increases the stability of shape of the blanks in desired manner.

In accordance with the present invention, metal powder consisting of a plurality of metal powder pellets is moreover processed in such a manner that metal powder is provided which consists of a plurality of metal powder particles which are not of spherical construction, but have projections, corners and edges. Particularly when the metal powder pellets in doughy state are accelerated before the collision process thereof it can happen that metal powder pellets break into pieces during the collision, so that several, even smaller deformed metal powder particles are formed from a metal powder pellet. This leads to a further improvement in the above-described and desired hooking of the metal powder particles in the blank and thus an even further improved stability of shape of the blank.

The invention claimed is:

1. Method of processing metal powder consisting of a plurality of metal powder pellets, comprising the following steps:

S1: heating the metal powder pellets until they are in a doughy state,

S2: causing a collision of the metal powder pellets in doughy state with a heated impact body until the pellets form deformed metal powder particles having projections, corners and edges, and S3: collecting the deformed metal powder particles having projections, corners and edges in a collecting vessel.

2. Method according to claim 1, further comprising the following further step:

S4: cooling the collected deformed metal powder particles until they are in a solid state.

3. Method according to claim 1, wherein an acceleration of the metal powder pellets in doughy state takes place between the heating of the metal powder pellets and the causing of a collision.

4. Method according to claim 3, wherein the acceleration of the metal powder pellets is carried out by a magnetic field, by means of a centrifuging process or by means of a protective gas flow.

5. Method according to claim 1, wherein the heating of the metal powder pellets is carried out with use of an induction process, by radiant heat or in a hot protective gas flow.

6. Method according to claim 1, wherein the metal powder pellets in doughy state are brought into collision with an impact plate.

7. Method according to claim 6, wherein the impact plate is of propeller-shaped construction.

8. Method according to claim 6, wherein the impact plate is constructed to be movable.

9. Method according to claim 8, wherein deformed metal powder particles are transported into the collecting vessel by means of the impact plate causing of the collision.

10. Method according to claim 1, wherein the metal powder pellets in doughy state are brought against one another for the collision in order to form deformed metal powder particles.

* * * * *